US005454515A

United States Patent [19]

Perret

[11] Patent Number: 5,454,515

[45] Date of Patent: Oct. 3, 1995

[54] SPRAY TIP FOR FLAT ORIFICE TIP

[76] Inventor: Robert J. Perret, Jr., 240 Nice La. #214, Newport Beach, Calif. 92668

[21] Appl. No.: 287,926

[22] Filed: Aug. 9, 1994

[51] Int. Cl.[6] ..... B05B 15/02

[52] U.S. Cl. ..... 239/119; 239/600

[58] Field of Search ..... 239/119, 600, 239/288–288.5

[56] References Cited

U.S. PATENT DOCUMENTS

| | | | |
|---|---|---|---|
| 4,165,836 | 8/1979 | Eull | 239/119 |
| 4,484,707 | 11/1984 | Calder | 239/119 |
| 4,757,947 | 7/1988 | Calder | 239/119 |
| 4,830,281 | 5/1989 | Calder | 239/119 |
| 5,280,853 | 1/1994 | Perret, Jr. | 239/119 |
| 5,294,053 | 3/1994 | Perret, Jr. | 239/119 |

FOREIGN PATENT DOCUMENTS

| | | | |
|---|---|---|---|
| 3239493 | 5/1983 | Germany | 239/119 |

*Primary Examiner*—Karen B. Merritt
*Attorney, Agent, or Firm*—Plante & Strauss

[57] ABSTRACT

There is disclosed a spray head of improved design for airless spraying of liquids which utilizes a rotatable turret member to provide for reversing of the position of the orifice spray orifice tip for cleaning purposes. The rotatable turret member houses a conventional flat tip orifice without compromising the sealing, or the strength and useful life, of the spray assembly. To this end, a cylindrical turret member is formed of two sectored cylinders, one of which has a recess which receives a conventional flat tip. The two sectored cylinders are joined and secured in a cylindrical turret subassembly by interlocking keys and slots, preferably at opposite ends. The spray head also has a spray guard of generally conventional design with a key and arcuate slot connection to index the position of the rotatable turret member at cleaning and spraying positions.

20 Claims, 2 Drawing Sheets

SPRAY TIP FOR FLAT ORIFICE TIP

BACKGROUND OF THE INVENTION

1. Field of the Invention

This invention relates to equipment for airless spraying of liquids and in particular to an improved spray tip assembly.

2. Brief Statement of the Prior Art

Airless spraying of liquids is a well established industry and is the predominately used method for professional spraying of paints and the like. The liquid is pressurized to relatively high pressures, e.g., 3,000 to about 5000 psi and is sprayed through a minute orifice formed of abrasive resistant materials, typically tungsten carbide.

The majority of the airless spray equipment uses a relatively low-cost orifice tip subassembly known as a "flat tip". The flat tip has a generally cylindrical case with a circular base and a small diameter through passageway in which is permanently seated a small orifice tip member. This construction efficiently minimizes the quantity of the relatively expense tungsten carbide required for the wear-resistent orifice tips.

One of the problems encountered in the airless spraying of liquids is that the minute diameter passageway in the orifice tip member tends to clog with debris or scale present in the liquid being sprayed. This tendency is combated to some extent by use of filters and careful preparation of the spraying liquid, however the problem is encountered sufficiently frequently that a reversible type of spray nozzles has been developed. These reversible spray nozzles typically contain the orifice tip member in a rotatable turret member which permits the position of the orifice tip member to be reversed so the spray liquid can be applied under high pressure to dislodge any obstructions from the orifice tip member.

Substantial improvements have been made in the design of the reversible tip spray heads, reducing their manufacturing costs and improving their use. One cost factor, however, which has not been significantly reduced is the relatively high cost of the custom orifice tips used in this construction. The orifice tips are formed of a wear-resistent material, usually tungsten carbide, and must be of sufficient size and configuration to be permanently mounted in the rotatable turret member.

A reversible spray head has recently been introduced to the market in which the rotatable cylindrical turret member is provided with a large internal recess to permit use of the comparatively inexpensive flat tips. This design utilizes a very large diameter counterbore in the turret member which receives the metal case of the flat orifice tip with an interlocking plug having an external surface contoured to the cylindrical wall of the rotatable turret member.

A difficulty with the aforementioned construction is that it significantly weakens the turret member. As previously mentioned, the spray heads are designed to spray liquids at high pressures, in excess of 3000 psi and any significant reduction in the wall thicknesses of the members renders them prone to stress failures.

OBJECTIONS OF THE INVENTION

It is an objective of this invention to provide an airless spray head of an improved design and construction.

It is also an object of this invention to provide an airless spray head which utilizes a rotatable turret for reversal and cleaning of the orifice tip.

It is a further object of this invention to provide a spray head for airless spraying equipment having a reversible orifice tip holder which utilizes a conventional flat orifice tip.

It is an additional objective of this invention to provide a spray head having seals of enhanced efficiency and improved design.

Other and related objectives will be apparent from the following description of the invention.

BRIEF STATEMENT OF THE INVENTION

This invention comprises a spray head of improved design for airless spraying of liquids which utilizes a rotatable turret member to provide for reversing of the position of the orifice spray orifice tip for cleaning purposes. The invention specifically utilizes a construction of the rotatable turret member which permits use of conventional flat tips without compromising the sealing, or the strength, or useful life, of the spray head assembly. To this end, a cylindrical turret member is formed of two sectored cylinders, one of which has a recess which receives a conventional flat tip. The two sectored cylinders are joined and secured into a cylindrical turret subassembly by interlocking keys and slots, preferably at opposite ends. The spray head assembly also has a spray guard of generally conventional design with a key and arcuate slot interlock with the turret member to index the position of the rotatable turret member at cleaning and spraying positions.

DESCRIPTION OF PREFERRED EMBODIMENTS

Figure 1:
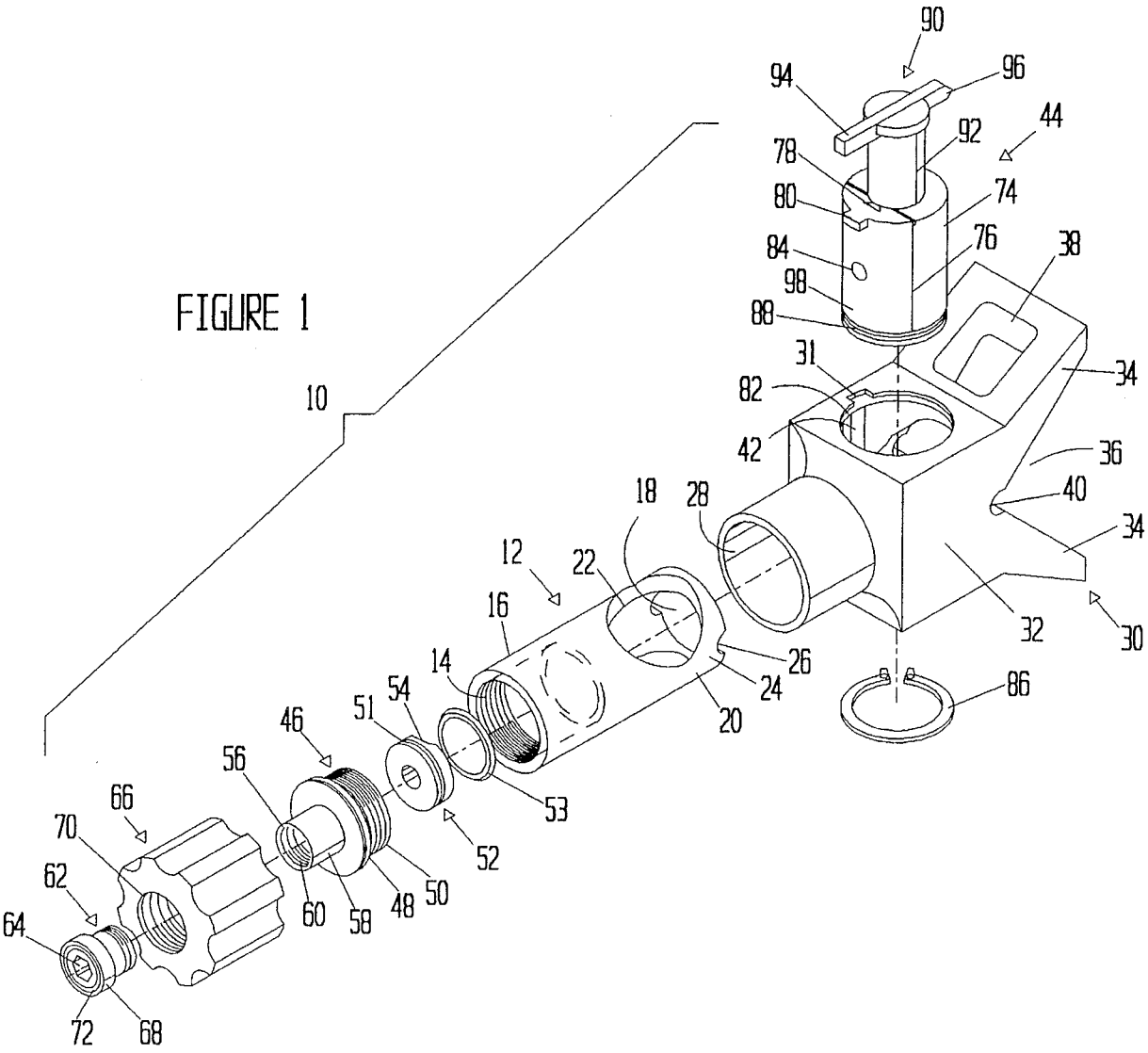
FIG. 1 is an exploded perspective view of the various major components of the spray head of the invention.

Referring now to FIG. 1, the spray head 10 of the invention comprises a generally cylindrical metallic housing sleeve 12 which has a through passageway that has internal threads 14 on its upstream end 16 and a lesser diameter concentric passageway 18 at its discharge end 20. The housing sleeve 12 also has an intersecting orthogonal through bore 22 which is of sufficient diameter to receive the turret member as described hereinafter. The opposite sidewalls 24 of the discharge end 20 of the sleeve have arcuate notches 26 to provide clearance for the spray pattern emitted by the orifice tip.

The housing sleeve 12 is received in a longitudinal through bore 28 of the spray guard 30, which has a molded plastic body 32 having a generally rectangular cross section. The spray guard 30 has a pair of diverging wings 34 on its discharge face 36 which provide sufficient obstructions to prevent the user from placing a finger in the path of the high pressure spray liquid emitted from the spray head. The wings can have various apertures 38 to reduce their mass. The body 32 of the spray guard 30 also has arcuate notches 40 in its opposite sidewalls to provide clearance for the spray pattern emitted from the spray tip. The spray guard body 30 has an orthogonal through bore 42 which aligns with the orthogonal through bore 22 of the housing sleeve 12 in the assembly to permit reception of the rotatable turret subassembly 44.

The housing sleeve 12 receives an adaptor 46 to permit assembly of the spray head 10 on the threaded end of a conventional spray gun. This adaptor 46 comprises a cylindrical plug 48 having an externally threaded downstream end 50 which is received in the internally threads 14 on the upstream end 16 of the housing sleeve 12. A seal washer 52 having a cylindrically concave face 54 is received in the longitudinal passageway 18 of the housing sleeve 12 and is sealed therein. An annular groove 51 is provided about the body of the seal washer 52, and an O-ring 53 is seated in groove 51 to provide an additional seal.

At its upstream end 56, the adaptor 46 has a cylindrical boss 58 having internal threads 60 to receive the threaded end of the plug 62, which has a hexagonally broached recess 64 to receive a conventional allen key for assembly. The plug 62 is received inside of the retainer nut 66 which has an annular flange (not shown) that captures the head 68 of the plug 62, thereby assembling the retainer nut on the adapter 46. The retainer nut 66 has an internally threaded upstream end 70 which fits the externally threaded discharge ends of conventional spray guns. The plug 62 also has, on its upstream face, an O-ring seal 72, which seals against the end of the barrel of the spray gun, when the retainer nut is tightened on the spray gun barrel.

The rotatable turret subassembly 44 is a subassembly of two sectored cylinders. The major sectored cylinder 74 is sectored along a face 76 to provide approximately 70% of the assembled cylinder and is assembled to a minor piece sectored cylinder 98 by a key and slot interlock on each end face, such as the key and slot interlock 78.

The turret subassembly 44 and the spray guard 30 also have indexing means such as the prong 80 on the turret subassembly 44, which is received in the discontinuous annular groove 82 of the spray guard body 32. A slot 31 in the top wall of the spray guard body 32 opens to the discontinuous annular groove 82. The discontinuous annular groove 82 extends through an arc of approximately 200° to 230° so that its opposite ends serve as stops for the prong 80 which permit rotation of the turret subassembly 44 through an arc of 180°, thereby orienting the turret subassembly 44 in spray and cleaning positions.

The turret subassembly 44 has a through bore 84 and internally houses a flat orifice tip member as described hereinafter with reference to FIG. 2. The turret subassembly 44 is retained in the assembled spray head by a spring lock washer 86 which seats in an annular groove 88 about the lower end of the turret subassembly 44.

The turret subassembly 44 also has a handle 90 which includes handle shaft 92 projecting from the upper end of the cylindrical subassembly 44 with a cross arm 94 to provide a hand grip and which has a pointed end 96 which indicates the directional orientation of the orifice tip within the turret subassembly 44.

Figure 2:
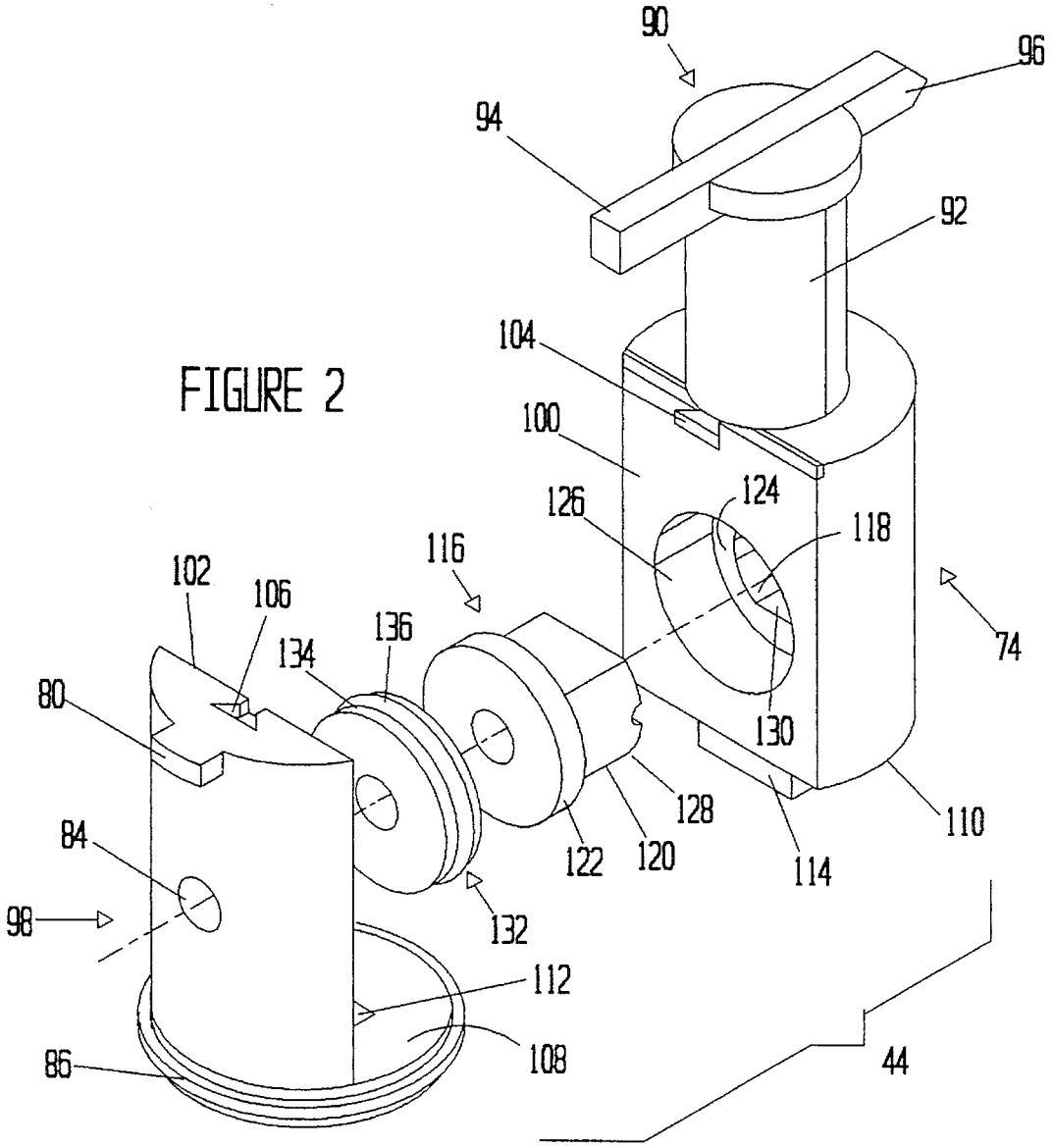
FIG. 2 is an exploded perspective view of the cylindrical turret subassembly.

Referring now to FIG. 2, the cylindrical turret subassembly 44 will be described. As illustrated, the turret subassembly 44 comprises a major sectored cylinder 74 and a minor sectored cylinder 98, which mate along their sectored faces 100 and 102, thereby forming a cylindrical turret subassembly 44. The key and slot interlock at the upper end of the subassembly 44 comprises a dovetail key 104 on the major sectored cylinder 74, and a mating dovetail slot 106 in the end face of the minor sectored cylinder 98. The key and slot can be of any desired configuration; the preferred dove-tail shape is illustrated.

The minor sectored cylinder 98 has a circular base 108 which is received against the bottom end wall 110 of the major sectored cylinder, and a second key and slot interlock is provided by a rectangular slot 112 in the circular base 108 of the minor sectored cylinder, which receives a mating rectangular key 114 on the bottom end wall 110 of the major sectored cylinder.

The circular base 108 has an annular groove, previously mentioned, to receive the spring lock washer 86, to retain the turret subassembly 44 in the spray head 10.

The rotatable turret subassembly 44 houses a conventional flat orifice tip 116. The flat orifice tip has a generally cylindrical housing with a circular base and a small diameter through passageway in which is permanently seated a small orifice tip member. The major sectored cylinder has a recess 118 of sufficient diameter to receive the metal housing 120 of the flat orifice tip 116 and an entrance 126 of greater diameter to receive the circular base 122 of the flat orifice tip 116. The internal annular shoulder 124 formed between the entrance 126 and recess 118 provides a stop to position the flat tip orifice 116 at a precise axial location in the through bore 84 of the turret subassembly 44. The conventional flat orifice tip case 120 has opposite flats 128 which index to flats 130 in the recess 118 to orient the angular position of the flat orifice tip 116. The flat tip orifice 116 is sealed in the assembly by washer 132 which has an annular groove 134 in which is seated a conventional O-ring seal 136. The minor sectored cylinder 98 has a small diameter through bore 84 which aligns coaxially with the entrance 126, recess 118 and thorough bore of the major sectored cylinder 74.

When the turret subassembly is in the spray guard, and the spray tip is tightly secured to the discharge barrel of a spray gun by retainer nut 66, the seals of the spray tip are compressed to seal against the applied pressure of the spray liquid. This also tightly secures the major sectored cylinder 74 in the assembly and prevents its removal, until the tension on the retainer nut is loosened.

The assembly of the minor and major sectored cylinders in the spray guard 30 and housing 20 also presses the seal washer 132 against the flat face of the base 122 of the flat fit orifice. This effects a frictional fit of the sectored cylinders which prevents their accidental dislodgement from the assembled spray tip even when the retainer nut has been loosened.

The turret subassembly 44 provides a very efficient and secure mounting for a conventional flat orifice tip. The subassembly uses simple but highly effective seals, specifically the seal washer and O-ring seal to secure the flat orifice tip in the assembly. The turret subassembly 44 is assembled by interlocking the sectored cylinders together along relatively expansive flat faces of the two pieces, which avoids weakening of the turret structure. Each sectored cylinder also presents a smooth uninterrupted cylindrical face for engagement by the floating seal 52 within the housing sleeve 12, and thus avoids any compromise in available sealing surface area.

The assembly also provides for very facile disassembly. The flat orifice tip 116 can be removed or interchanged quite easily simply by loosening the tension on the retainer nut 66, and withdrawing the major sectored cylinder 74 from the assembly, and extracting the seal washer 132 and the flat tip 116. No special tools are required and the spray head can be restored to service by inserting a new flat orifice tip in the major sectored cylinder, reinserting it into the spray head 10, and completing the assembly by tightening of the retainer nut 66 on the spray gun barrel to compress the internal seals sufficiently to prevent leakage of the liquid being sprayed.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a spray tip assembly for airless spraying of liquids which includes a spray tip housing having a longitudinal through bore and an orthogonal, intersecting transverse bore which rotatably receives a cylindrical turret member that supports a flat orifice tip member comprising a base and tip housing for receiving an orifice tip, the improvement comprising:

a. a two-piece cylindrical turret subassembly formed of a first, major piece of cylindrical sector shape with a longitudinal flat face, and a second minor piece, also of a cylindrical sector shape and having a second longitudinal flat face, with said first and second pieces joined together with said flat faces in adjacent proximity to form said cylindrical turret member;

b. a pair of interlocking means, one each on each end of said turret subassembly, each interlocking means comprising a key and a key recess, one on one of said first and second pieces, and the other on the other of said pieces to retain said turret subassembly;

c. a first through bore of a first diameter in said first piece, orthogonal to its longitudinal axis and a counterbore coaxial to and of larger diameter than said through bore in said first flat face to form an internal annular shoulder within said first piece, with said orifice tip member removably received within said counterbore, with the base of said orifice tip member received against said internal annular shoulder; and d. a resilient seal washer received in and resiliently sealing about said counterbore.

2. The spray tip assembly of claim 1 wherein said second piece has a circular base plate which is received against an end of said first piece, and one of said pair of interlocking means comprises a key and recess, one of which is carried on one of said circular base plate and the end of said first piece, and the other is carried on the other of said plate and first piece, with said key received within said key recess, thereby interlocking said first and second pieces.

3. The spray tip assembly of claim 1 including a turret handle which extends coaxially with said cylindrical turret subassembly.

4. The spray tip assembly of claim 1 wherein said housing comprises a sleeve.

5. The spray tip assembly of claim 1 including an adapter carried on an end of said spray tip assembly with attachment means permitting its removable attachment to a spray gun.

6. The spray tip assembly of claim 5 including a spray guard carried on the end of said spray tip housing opposite said end that carries said adapter.

7. The spray tip assembly of claim 6 wherein said spray guard has a pair of outwardly divergent wings which extend forwardly of said spray tip housing.

8. The spray tip assembly of claim 7 wherein said spray guard has a cylindrical chamber which receives said housing.

9. The spray tip assembly of claim 8 wherein said spray guard has a transverse through aperture intersecting said cylindrical chamber to receive said turret subassembly.

10. The spray tip assembly of claim 9 wherein said turret subassembly has a radial prong projecting from an upper edge of said cylindrical turret member, and said spray guard has an annular groove about an upper inside edge of said through aperture, together with a radial slot extending from an upper face of said spray guard and intersecting said annular groove to provide a keyway for said radial prong.

11. A spray tip assembly for airless spraying of liquids under high pressure which comprises:

a. a spray tip housing having a longitudinal through bore and an orthogonal, intersecting transverse bore;

b. a cylindrical turret member rotatably received in said intersecting transverse bore and formed as a two-piece cylindrical turret subassembly comprising a first, major piece of cylindrical sector shape with a longitudinal flat face, and a second minor piece, also of a cylindrical sector shape and having a second longitudinal flat face, with said first and second pieces joined together with said flat faces in adjacent proximity to form said cylindrical turret member;

c. a pair of interlocking means, one each on each end of said turret subassembly, each interlocking means comprising a key and a key recess, one on one of said first and second pieces, and the other on the other of said pieces to retain said turret subassembly;

d. a first through bore of a first diameter in said first piece, orthogonal to its longitudinal axis and a counterbore coaxial to and of larger diameter than said through bore in said first flat face to form an internal annular shoulder within said first piece, e. a flat orifice tip member comprising a base and tip housing for receiving an orifice tip and removably received within said counterbore, with the base of said orifice tip member received against said internal annular shoulder; and f. a resilient seal washer received in and resiliently sealing about said counterbore.

12. The spray tip assembly of claim 11 wherein said second piece has a circular base plate which is received against an end of said first piece, and one of said pair of interlocking means comprises a key and recess, one of which is carried on one of said circular base plate and the end of said first piece, and the other is carried on the other of said plate and first piece, with said key received within said key recess, thereby interlocking said first and second pieces.

13. The spray tip assembly of claim 12 including a turret handle which extends coaxially with said cylindrical turret subassembly.

14. The spray tip assembly of claim 12 wherein said housing comprises a sleeve.

15. The spray tip assembly of claim 12 including an adapter carried on an end of said spray tip assembly with attachment means permitting its removable attachment to a spray gun.

16. The spray tip assembly of claim 15 including a spray guard carried on the end of said spray tip housing opposite said end that carries said adapter.

17. The spray tip assembly of claim 16 wherein said spray guard has a pair of outwardly divergent wings which extend forwardly of said spray tip housing.

18. The spray tip assembly of claim 17 wherein said spray guard has a cylindrical chamber which receives said housing.

19. The spray tip assembly of claim 18 wherein said spray guard has a transverse through aperture intersecting said cylindrical chamber to receive said turret subassembly.

20. The spray tip assembly of claim 19 wherein said turret subassembly has a radial prong projecting from an upper edge of said cylindrical turret member, and said spray guard has an annular groove about an upper inside edge of said through aperture, together with a radial slot extending from an upper face of said spray guard and intersecting said annular groove to provide a keyway for said radial prong.

* * * * *